United States Patent [19]

Kamp

[11] 4,028,136

[45] June 7, 1977

[54] METHOD AND DEVICE FOR CLEANSING SPINNING TURBINES OF A SPINNING MACHINE

[75] Inventor: Heinz Kamp, Rickelrath, Germany

[73] Assignee: W. Schlafhorst & Co., Monchengladbach, Germany

[22] Filed: Dec. 3, 1975

[21] Appl. No.: 637,461

[30] Foreign Application Priority Data

Dec. 3, 1974 Germany ..... 2457034

[52] U.S. Cl. ..... 134/8; 15/312 R; 57/56; 134/24

[51] Int. Cl.[2] ..... B08B 1/04; B08B 5/02

[58] Field of Search ..... 134/6, 8, 22 R, 24, 134/37; 15/301, 312 R, 316 R, 315, 406, 414, 104.1 R, 104.11; 57/56, 156

[56] References Cited

UNITED STATES PATENTS

| | | | |
|---|---|---|---|
| 1,785,821 | 12/1930 | Snow | 15/316 R |
| 3,304,570 | 2/1967 | Seress et al. | 15/312 R |
| 3,524,312 | 8/1970 | Landwehrkamp et al. | 57/56 |
| 3,869,747 | 3/1975 | Richter | 15/104.1 R |
| 3,938,218 | 2/1976 | DeAmicis | 15/414 X |

FOREIGN PATENTS OR APPLICATIONS

| | | | |
|---|---|---|---|
| 1,196,051 | 6/1970 | United Kingdom | 57/56 |

*Primary Examiner*—S. Leon Bashore
*Assistant Examiner*—Richard V. Fisher
*Attorney, Agent, or Firm*—Herbert L. Lerner

[57] ABSTRACT

A system for cleansing spinning turbines of a spinning machine which includes driving a cleansing device having a telescoping tube assembly provided with a rotary cleansing brush at one end thereof from spinning turbine to spinning turbine located at respective spinning stations of the spinning machine, inserting the one end of the telescoping tube assembly with the rotary cleansing brush provided thereat into the respective spinning turbine, and connecting the other end of the telescoping tube assembly to a source of compressed air.

6 Claims, 4 Drawing Figures

METHOD AND DEVICE FOR CLEANSING SPINNING TURBINES OF A SPINNING MACHINE

The invention relates to a method and device for cleansing spinning turbines of a spinning machine.

The spinning turbines of a spinning machine, as is generally known, must be periodically cleansed of residues, especially before start-up of the respective spinning units or stations of the machine. The residues often adhere very firmly to the fiber collecting trough or to the surface defining the inner turbine chamber.

It has been proposed heretofore to employ rotating brushes for cleansing the spinning turbines. Blown air and suction air have also been used heretofore for cleansing. When used separately, the aforementioned cleansing means have proven to have too little effect, however. Only the exchange of mechanical and pneumatic cleansing can lead to satisfactory results.

It is accordingly an object of the invention to provide a method and device for cleansing spinning turbines of a spinning machine which avoids the disadvantages of the heretofore known method and devices of this general type and which affords satisfactory cleansing in one operation.

More specifically, it is an object of the invention to provide such a method and device by which the cleansing is accelerated and automatized in conjunction with a simplification and improvement in the supply of compressed air.

With the foregoing and other objects in view, there is provided in accordance with the invention, a method of cleansing spinning turbines of a spinning machine which comprises driving a cleansing device having a telescoping tube assembly provided with a rotary cleansing brush at one end thereof from spinning turbine to spinning turbine located at respective spinning stations of the spinning machine, inserting the one end of the telescoping tube assembly with the rotary cleansing brush provided thereat into the respective spinning turbine, and connecting the other end of the telescoping tube assembly to a source of compressed air. The invention thus affords automatic cleansing of the respective spinning turbine in one operative step. The mechanically loosened residues are simultaneously removed by being blown out of the spinning turbine.

In accordance with another feature of the method of the invention, the other end of the telescoping tube assembly is connected to a tap connection of a stationary compressed air line extending from one spinning station to another.

In accordance with the device of the invention for carrying out the foregoing method, there are provided carriage means drivable from one spinning station of a spinning machine to another thereof, a rotary telescoping tube assembly mounted on the carriage means and displaceable eccentric to the axis of an opened spinning turbine located at a respective spinning station, the telescoping tube assembly having a cleansing brush at one end thereof and being connectible by the other end thereof to a source of compressed air. The carriage means is controllable by suitable means so that it is capable of being brought into registry with or of stopping at each of the respective spinning units or stations of the machine.

In accordance with another feature of the invention, the device includes a wobble nozzle angularly extending from the telescoping tube assembly at the one end thereof at which the cleansing brush is located. The angularly extending wobble nozzle conducts the compressed air stream very close to the location of the fiber collecting trough, which is, in fact, being cleansed mechanically. Moreover, a wobble nozzle, if rotatably mounted, is capable of rotating extraordinarily rapidly under the effect of the outwardly flowing air independently of the rotation of the telescoping tube assembly. This can intensify the cleansing process under certain conditions.

In accordance with a further feature of the invention, the device includes a compressed air line extending from spinning station to spinning station of the machine, and a movable line connected to the telescoping tube assembly at the other end thereof and having a plug-and-socket connection, the movable line being connectible by the plug-and-socket connection to the compressed air line.

The rotation of the telescoping tube essembly need be begun only shortly before it is introduced into the respective spinning turbine. Consequently, in accordance with yet another feature of the invention, the telescoping tube assembly comprises a displaceable outer tube, a first clutch half coaxially mounted on and fixed to the outer tube, a rotating second clutch half disposed coaxially to the outer tube, the outer tube being displaceable in direction toward the respective spinning turbine, the first clutch half being engageable with the second clutch half so as to rotate therewith when the outer tube is displaced in the direction toward the respective spinning tube.

Other features which are considered as characteristic for the invention are set forth in the appended claims. Although the invention is illustrated and described herein as embodied in method and device for cleansing spinning turbines of a spinning machine, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawing, in which.

Figure 1:
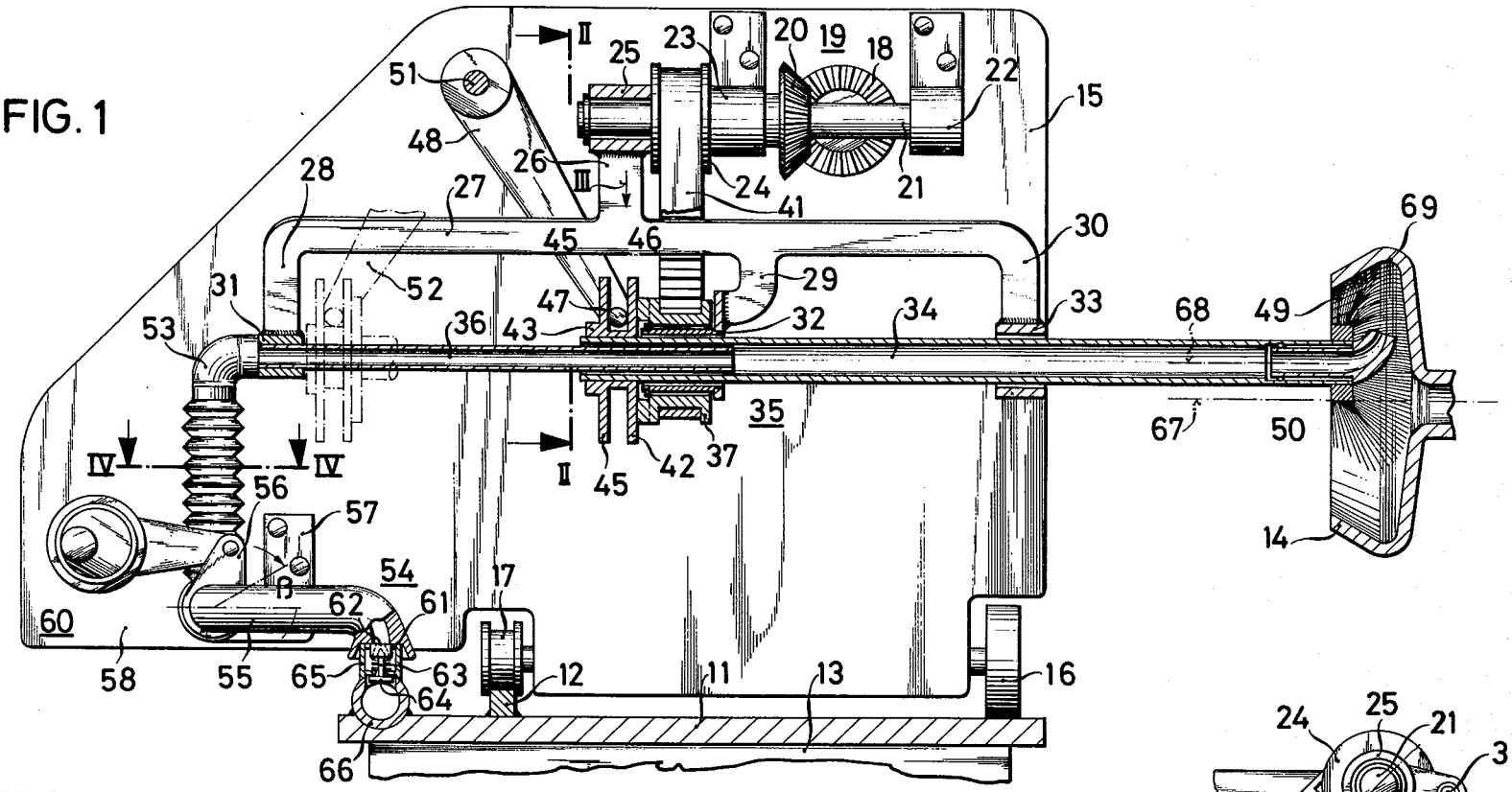
FIG. 1 is a longitudinal sectional view of the device for cleansing spinning turbines of a spinning machine constructed in accordance with the invention.

Referring now to the drawing and, first, particularly, to FIG. 1 thereof, there is shown a machine frame 13 of a spinning machine, having a multiplicity of spinning units or stations that are provided with respective spinning turbines 14, only one of which is shown in FIG. 1. A platform 11 is provided on the machine frame 13 and carries a rail 12 on and along which a cleansing device 15 is capable of traveling. As illustrated in FIG. 1, the spinning turbine 14 is, at the moment, in cleansing position thereof.

The cleansing device 15 is provided with supporting rollers or wheels 16 and rim rollers 17. A bevel gear 18 or a bevel gear transmission system 19 is drivable by a non-illustrated motor during the cleansing process. The rotation of the bevel gear 18 is transmitted to the bevel gear 20, also of the transmission system 19, and thereby to a shaft 21 which is mounted in sliding or journal bearings 22 and 23 and firmly connected against relative rotation to the bevel gear 20. A belt pulley 24 formed with rims or flanges is similarly connected to the shaft 21.

A roller 25 rotatably mounted on the shaft 21 has an arm 26 secured thereto, as by welding, and extending therefrom. The arm 26 is, in turn, connected to three other arms 28, 29 and 30, as shown in FIG. 1. Slide or journal bearings 32 and 33 are disposed in mutual alignment at the ends of the arms 29 and 30, respectively.

An outer tubular member 34 of a telescoping tube assembly 35 is slidingly and simultaneously axially displaceably mounted in the journal bearings 32 and 33. A bushing 31, which is in mutual alignment with the journal bearings 32 and 33, is secured to the end of the arm 28 and is connected to an inner tubular member 36 of the telescoping tube assembly 35.

The arms 26, 28, 29 and 30 and a traverse or cross-tie rod 27, which connects the arm 28, 29 and 30 to the arm 26, are pivotable as a unit with the roller 25 through an angle $\alpha$ (FIG. 2) about the shaft 21 by means of a lever 38 secured to the roller 25. The pivoting of the arms 26, 28, 29 and 30 is performed by a control rod 40 which is articulatingly connected to the lever 38 by a joint 39.

A clutch half 37, formed as a belt pulley and provided with radial toothing or serration 42, is rotatably mounted on the journal bearing 32.

A toothed belt 41 (also see FIG. 2) connects the belt pulley 24 to the clutch half 37. The accompanying second clutch half 43 is likewise provided with radial toothing or serrations 44 corresponding to and meshable with those of the first-mentioned clutch half 37, and is additionally provided with two rims or flanges 45 and 46 between which a guide pin 47 of a control lever 48 is received (also see FIG. 3).

The clutch half 43 is firmly connected against relative rotation to one end of the outer tubular member 34. A cleansing brush 49 and a wobble nozzle 50 are rotatably mounted at the other end of the outer tubular member 34. The control lever 48 is pivotable about a shaft 51 fixed to the housing 58 of the cleansing device 15 from the position 48 thereof shown in solid lines to the position 52 thereof shown in phantom.

Figure 4:
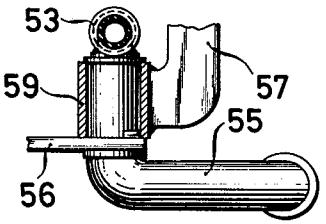
FIG. 4 is a fragmentary cross-sectional view of FIG. 1 taken along the line IV-IV in the direction of the arrows.

One end of the inner tubular member 36 is connected to a hose line 53 which leads, in turn, to a plug-and-socket connection 54. The plug-and-socket connection 54 is formed of an angularly bent tube 55 which is pivotable by means of a lever 56 (also see FIG. 4). As shown particularly in FIG. 4, the bent tube 55 is rotatably mounted in a bearing bushing 59 connected by a holder 57 to the housing 58 of the cleansing device 15 of the invention. The tube 55 of the plug-and-socket connection 54 is pivotable about the axis of the bearing bushing 59 through an angle $\beta$ by means of an eccentric drive 60.

The free end of the tube 55 is widened funnel-like and provided with a sealing ring 61. A pin 63 connected through a spider or star-shaped holder 62 to the tube 55 opens in turned-on condition, a valve 64 which is disposed in a tap connection 65 located at each spinning unit or station in a compressed air line 66 which extends from spinning station to spinning station.

Before the start of the cleansing process at the respective spinning station, the control lever is located in the position 52 thereof shown in phantom in FIG. 1. The clutch half 43 and all of the components secured thereto are withdrawn to the limit position thereof shown in phantom at the left-hand side of FIG. 1. Arms 26, 28, 29 and 30 and the traverse or cross-tie rod 27 and pivoted as a unit through the angle $\alpha$ shown in FIG. 2, so that the central axis of the telescoping tube assembly 35 assumes the position 67 in FIG. 1. The tube 55 is pivoted through the angle $\beta$ shown in FIG. 1, and the valve 64 of the tap connection 65 is closed.

To introduce the cleansing process, the bevel gear 18 is set into rotation by energizing the non-illustrated motor connected thereto, and the plug-and-socket connection 54 is connected at the tap connection 65, the tube 55 being pivoted downwardly or clockwise, as viewed in FIG. 1, through the angle $\beta$, and the clutch half 37 is set into rotation through the bevel gear transmission system 19, the belt pulley 24 and the toothed belt 41. The control lever then swings from the position 52 thereof shown in phantom in FIG. 1 to the position 48 thereof shown in solid lines in that figure. The moment that the radial toothing or serrations 44 of the clutch half 43 mesh with the radial toothing or serrations 42 of the clutch half 37, the outer tubular member 34 and the cleansing brush 49 are also simultaneously set into rotation. The wobble nozzle 50 rotates independently thereof just as soon as compressed air flows through the nozzle 50.

Figure 2:
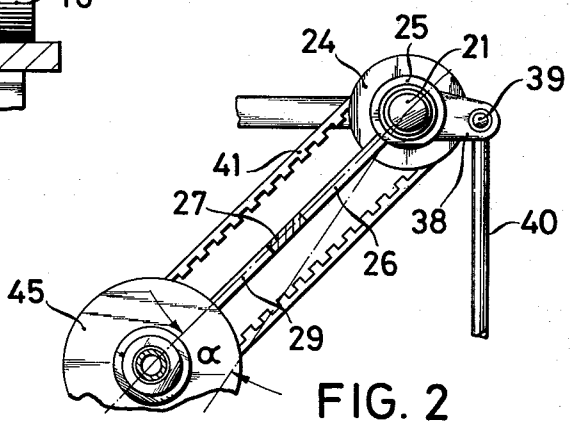
FIG. 2 is a fragmentary cross-sectional view of FIG. 1 taken along the line II-II in the direction of the arrows.
Figure 3:
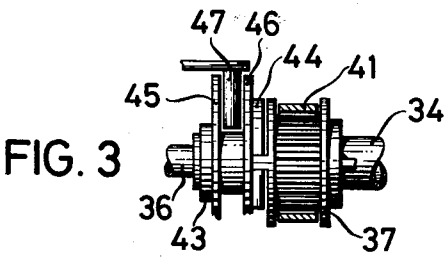
FIG. 3 is a fragmentary top plan view, partly in section, of the device of FIG. 1 showing the clutch device thereof as seen from above in direction of the arrow III in FIG. 1.

The arms 26, 28, 29 and 30 and the traverse 27 are then swung upwardly or clockwise, as shown in FIG. 2, through the angle $\alpha$ by means of the control rod 40 whereby the central axis 67 of the telescoping tube assembly 35 assumes the position 68 thereof, as shown in FIG. 1. The cleansing brush 49 is accordingly shifted in direction of the collecting trough 69 of the spinning turbine 14 and the cleansing effect is thereby intensified, since most of the impurities and soil entities are present in the collecting trough 69.

Because the cleansing occurs as the turbine 14 is slowing down and, even when the turbine is stationary, due to the rotating brush and the rotating air current which quite automatically set the turbine into rotation, all of the confines of the turbine interior are cleansed equally well. As seen from the drawing, the rotary brush is rotated independently of the rotatable spinning turbine so as to cleanse the inner surface of the rotatable spinning turbine therewith and with the compressed air.

The impurities and soil entities loosened by the cleansing brushes 49 are driven out into the free atmosphere due to the whirling air current. Operation of the cleansing device 15 is discontinued by reversing the foregoing sequence of working steps. As mentioned hereinbefore, the invention of the instant application is not limited to the aforedescribed and illustrated embodiment. The rotational drive of the telescoping tube assembly 35 could be constructed quite differently, for example, the compressed air source could be formed of a compressed air bottle or a compressor carried along by the cleansing device 15, and the wobbling nozzle 50 could rotate advantageously in the direction opposite to the direction of rotation of the cleansing brush 49.

I claim:

1. Method of cleansing rotatable spinning turbines located at respective spinning stations of a spinning machine which comprises driving a cleansing device having a telescoping tube assembly provided with a rotary cleansing brush at one end thereof from spinning turbine to spinning turbine of the spinning machine, inserting the one end of the telescoping tube assembly with the rotary cleansing brush provided thereat into the respective rotatable spinning turbine, connecting the other end of the telescoping tube assembly to a source of compressed air and rotating the rotary brush independently of the rotatable spinning turbine so as to cleanse the inner surface of the rotatable spinning turbine therewith and with the compressed air.

2. Method according to claim 1 wherein the other end of the telescoping tube assembly is connected to a tap connection of a stationary compressed air line extending from one spinning station to another.

3. Device for carrying out a method of cleansing rotatable spinning turbines located at respective spinning stations of a spinning machine comprising carriage means drivable from one spinning station of the spinning machine to another thereof, a rotary telescoping tube assembly mounted on said carriage means and displaceable eccentric to the axis of an opened spinning turbine located at a respective spinning station, said telescoping tube assembly having a cleansing brush at one end thereof, and means connected to the other end of said telescoping tube assembly for supplying compressed air to said cleansing brush; and means for rotating said rotary brush independently of the rotatable spinning turbine so as to cleanse the inner surface of the rotatable spinning turbine therewith and with the compressed air.

4. Device according to claim 3 including a wobble nozzle angularly extending from said telescoping tube assembly at said one end thereof at which said cleansing brush is located.

5. Device according to claim 3 wherein said compressed air supply means is connected to a compressed air line extending from spinning station to spinning station of the machine, and comprises a movable line connected to said telescoping tube assembly at said other end thereof and having a plug-and-socket connection, said movable line being connectible by said plug-and-socket connection to said compressed air line.

6. Device for carrying out a method of cleansing spinning turbines of a spinning machine comprising carriage means drivable from one spinning station of a spinning machine to another thereof, a rotary telescoping tube assembly mounted on said carriage means and displaceable eccentric to the axis of an opened spinning turbine located at a respective spinning station, said telescoping tube assembly having a cleansing brush at one end thereof, and means for supplying compressed air to said cleansing brush connected to the other end of said telescoping tube assembly, said telescoping tube assembly comprising a displaceable outer tube, a first clutch half coaxially mounted on and fixed to said outer tube, a rotating second clutch half disposed coaxially to said outer tube, said outer tube being displaceable in direction toward the respective spinning turbine, said first clutch half being engageable with said second clutch half so as to rotate therewith when said outer tube is displaced in said direction toward the respective spinning turbine.

* * * * *